US009957957B2

(12) United States Patent
Ishikawa et al.

(10) Patent No.: US 9,957,957 B2
(45) Date of Patent: May 1, 2018

(54) ELECTROMAGNETIC PUMP

(71) Applicant: AISIN AW CO., LTD., Anjo-shi, Aichi-ken (JP)

(72) Inventors: Kazunori Ishikawa, Toyota (JP); Takahiro Kokubu, Nishio (JP); Masaya Nakai, Tokoname (JP); Tomomi Ishikawa, Anjo (JP)

(73) Assignee: AISIN AW CO., LTD., Anjo-shi, Aichi-ken (JP)

( * ) Notice: Subject to any disclaimer, the term of this patent is extended or adjusted under 35 U.S.C. 154(b) by 391 days.

(21) Appl. No.: 14/431,833

(22) PCT Filed: Oct. 29, 2013

(86) PCT No.: PCT/JP2013/079260
§ 371 (c)(1),
(2) Date: Mar. 27, 2015

(87) PCT Pub. No.: WO2014/069455
PCT Pub. Date: May 8, 2014

(65) Prior Publication Data

US 2015/0260172 A1 Sep. 17, 2015

(30) Foreign Application Priority Data

Oct. 31, 2012 (JP) ..... 2012-240573

(51) Int. Cl.
*F04B 17/03* (2006.01)
*F04B 7/02* (2006.01)
*F04B 17/04* (2006.01)

(52) U.S. Cl.
CPC ..... *F04B 17/03* (2013.01); *F04B 7/02* (2013.01); *F04B 17/04* (2013.01)

(58) Field of Classification Search
CPC ..... F04B 17/03; F04B 17/04–17/044; F04B 17/046; F04B 7/02; F04B 53/005;
(Continued)

(56) References Cited

U.S. PATENT DOCUMENTS 4,743,179 A 5/1988 Waas et al.
4,832,582 A 5/1989 Buffet
(Continued)

FOREIGN PATENT DOCUMENTS

DE 3504789 A1 8/1986
DE 9312752 U1 2/1994
(Continued)

OTHER PUBLICATIONS

International Search Report for PCT/JP2013/079260 dated Nov. 26, 2013.
(Continued)

*Primary Examiner* — Charles Freay
*Assistant Examiner* — Christopher Brunjes
(74) *Attorney, Agent, or Firm* — Sughrue Mion, PLLC

(57) ABSTRACT

A plate spring is attached to the distal-end portion of a piston. The distance L1 between the distal-end portion of a plunger and a core (recessed portion) that faces the distal-end portion of the plunger is set to be shorter than the distance L2 between the distal-end portion (plate spring) of the piston and the projecting end surface of a valve main body that faces the distal-end portion of the piston with drive of a solenoid portion stopped. Consequently, when the solenoid portion is driven, the plate spring collides against the projecting end surface of the valve main body so that the plunger does not collide against the core. As a result, a shock applied to the piston can be absorbed by the elastic force of the plate spring, which suppresses generation of a sound of collision.

11 Claims, 5 Drawing Sheets

(58) Field of Classification Search
CPC ..... F04B 53/20; F04B 53/22; F04B 53/126; B01D 35/02; B01D 35/157; B01D 35/30; B01D 35/306; B01D 2201/305; B01D 2201/16; B01D 2201/162; B01D 2201/04; B01D 2201/0415
See application file for complete search history.

(56) References Cited

U.S. PATENT DOCUMENTS

| | | | | |
|---|---|---|---|---|
| 5,437,339 | A * | 8/1995 | Tanaka | B25C 1/047 173/210 |
| 2007/0183911 | A1* | 8/2007 | Maeda | B60T 8/4031 417/470 |
| 2011/0293449 | A1 | 12/2011 | Shimizu et al. | |
| 2011/0314990 | A1* | 12/2011 | Sasaki | C03B 33/10 83/663 |
| 2012/0244013 | A1* | 9/2012 | Nakai | F04B 17/042 417/50 |
| 2012/0244014 | A1 | 9/2012 | Nakai et al. | |
| 2013/0034459 | A1 | 2/2013 | Mueller et al. | |

FOREIGN PATENT DOCUMENTS

| | | | | |
|---|---|---|---|---|
| DE | 19925250 | A1 * | 12/2000 | B60T 8/4031 |
| DE | 102007031033 | A1 | 10/2007 | |
| DE | 102008013440 | A1 | 9/2009 | |
| DE | 112012000094 | T5 | 8/2013 | |
| EP | 0286404 | B1 | 7/1991 | |
| JP | 11-117858 | A | 4/1999 | |
| JP | 2005-240599 | A | 9/2005 | |
| JP | 2011-21593 | A | 2/2011 | |
| JP | 2011-252491 | A | 12/2011 | |
| WO | 2011/116752 | A2 | 9/2011 | |

OTHER PUBLICATIONS

English summary of the Official Communication dated Sep. 30, 2015 from the German Patent and Trademark Office in counterpart application No. 102013004084.0.

* cited by examiner

ELECTROMAGNETIC PUMP

CROSS REFERENCE TO RELATED APPLICATIONS

This application is a National Stage of International Application No. PCT/2013/079260 filed Oct. 29, 2013, claiming priority based on Japanese Patent Application No. 2012-240573 filed Oct. 31, 2012, the contents of all of which are incorporated herein by reference in their entirety.

TECHNICAL FIELD

The subject matter described hereinrelates to an electromagnetic pump in which a piston is moved back and forth to suction and discharge a working fluid.

BACKGROUND ART

Hitherto, there has been proposed an electromagnetic pump of this type, including: a piston; an electromagnetic portion that attracts a plunger to a core using an electromagnetic force to move the piston forward; a spring that applies an urging force that is opposite in direction to the electromagnetic force to move the piston in reverse; an end plate that supports the spring; a suction check valve built in the end plate; and a discharge check valve built in the piston (see Patent Document 1, for example). In the electromagnetic pump, the electromagnetic portion is energized and de-energized to move the piston back and forth to suction working oil via the suction check valve and discharge the suctioned working oil via the discharge check valve.

RELATED-ART DOCUMENTS

Patent Documents

[Patent Document 1] Japanese Patent Application Publication No. 2011-21593 (JP 2011-21593 A)

SUMMARY OF THE INVENTION

In the electromagnetic pump discussed above, each time the electromagnetic portion is energized, the plunger collides against the core to generate a sound of collision. When it is considered that the electromagnetic pump is mounted on a vehicle, for example, the generated sound of collision may serve as an abnormal sound to give a sense of discomfort to a passenger, and therefore is desirably suppressed as much as possible. In order to address such an issue, it is conceivable to provide a shock absorbing member to a surface of collision of the core against which the plunger collides. Because it is necessary to use a non-magnetic body as the shock absorbing member in order not to affect drive of the electromagnetic portion, however, the range of material selection is narrowed. Thus, sufficient durability may not be secured, and the cost may not be advantageous. Because it is necessary to dispose the shock absorbing member in a limited space of the electromagnetic portion, in addition, it is inevitable that the shock absorbing member is reduced in size more than necessary, and sufficient shock absorbing performance may not be obtained.

A main object of the present electromagnetic pump is to appropriately relieve a shock accompanied by drive of an electromagnetic portion to suppress generation of an abnormal sound.

In order to achieve the foregoing main object, the electromagnetic pump adopts the following:

an electromagnetic pump in which a piston is moved back and forth to suction and discharge a working fluid, including:

an electromagnetic portion that attracts a plunger to a core using an electromagnetic force to apply thrust to a base-end portion of the piston to move the piston forward;

a spring that applies an urging force to a distal-end portion of the piston to move the piston in reverse;

a support member that supports the spring and that has a specific portion that faces the distal-end portion of the piston; and an elastic member provided to at least one of the distal-end portion of the piston and the specific portion of the support member, in which a distance between the specific portion of the support member and the distal-end portion of the piston is shorter than a distance between the plunger and the core when the electromagnetic portion is stationary so that the distal-end portion of the piston collides against the specific portion of the support member via the elastic member when the electromagnetic portion is driven to move the piston forward.

In the electromagnetic pump, the elastic member is provided to at least one of the distal-end portion of the piston and the specific portion of the support member, which face each other, and the distance between the specific portion of the support member and the distal-end portion of the piston is set to be shorter than the distance between the plunger and the core when the electromagnetic portion is stationary so that the distal-end portion of the piston collides against the specific portion of the support member via the elastic member when the electromagnetic portion is driven to move the piston forward. Consequently, a shock of the collision is absorbed by the elastic member, which effectively suppresses generation of a collision sound. Because it is not necessary to constitute the elastic member from a non-magnetic body, in addition, the range of material selection is widened, which makes it possible to improve the durability and reduce the cost. Because there is an abundant arrangement space compared to a configuration in which the elastic member is disposed in the electromagnetic portion, sufficient shock absorbing performance can be obtained by disposing an elastic member with appropriate performance. As a result, it is possible to appropriately relieve a shock accompanied by drive of the electromagnetic portion to suppress generation of an abnormal sound.

In the present electromagnetic pump according to an exemplary embodiment, the support member may be formed with a support portion that supports the spring, and a projecting portion that projects toward the distal-end portion of the piston with respect to the support portion; and the specific portion may be a projecting end surface of the projecting portion. Accordingly, the distance between the specific portion of the support member and the distal-end portion of the piston can be easily controlled while securing a necessary urging force of the spring.

In the electromagnetic pump according to the exemplary embodiment, in addition, the spring may be a coil spring; the distal-end portion of the piston may be formed as a cylindrical portion with an annular cylindrical end surface configured to receive an urging force of the coil spring; the elastic member may be a plate spring attached so as to cover an opening of the cylindrical portion; and the specific portion of the support member may be formed such that an outside diameter of the specific portion is smaller than an inside diameter of the cylindrical portion. Accordingly, elongation of the axial length of the electromagnetic pump can be suppressed by using a plate spring as the elastic member.

In the electromagnetic pump according to an exemplary embodiment in which the elastic member is a plate spring, an inner peripheral edge of the cylindrical end surface of the cylindrical portion of the piston may be chamfered. Accordingly, the elastically deformable region of the plate spring can be expanded without increasing the diameter of the piston, which further improves the shock absorbing performance. As a result, generation of an abnormal sound can be more reliably suppressed.

In the electromagnetic pump according to an exemplary embodiment in which the elastic member is a plate spring, in addition, the plate spring may include a disc portion that covers the opening of the cylindrical portion, and a plurality of leg portions that extend along an axial direction of the cylindrical portion from an outer peripheral edge of the disc portion. In the electromagnetic pump according to such an embodiment, the disc portion and the leg portions of the plate spring may be formed integrally, and the plate spring may be provided with cut-away portions formed on both sides of a root of the leg portions. Accordingly, sufficient flatness can be secured in the vicinity of the outer peripheral edge of the disc portion even if the leg portions are bent along the axial direction of the cylindrical portion of the piston, which improves the ease of assembly of the plate spring.

In the electromagnetic pump according to an exemplary embodiment in which the plate spring includes a disc portion and a plurality of leg portions, the piston may be moved back and forth to suction the working fluid via a suction check valve and discharge the suctioned working fluid via a discharge check valve; the discharge check valve may be built in the cylindrical portion of the piston; and the plate spring may be provided with a plurality of communication holes formed in a surface of collision that collides against the specific portion of the support member, the plurality of communication holes allowing the working fluid to flow into the discharge check valve. In the electromagnetic pump according to such an embodiment, the communication holes may be formed in the disc portion in a generally elliptic shape with long sides extending in a circumferential direction and with short sides extending in a radial direction. Accordingly, the working fluid can be caused to smoothly flow into the discharge check valve via the plate spring. In the electromagnetic pump according to such an embodiment, in addition, three communication holes may be formed at equal angular intervals in the circumferential direction. Accordingly, a stress can be dispersed when the plate spring receives an impact, which secures the durability of the plate spring. In the electromagnetic pump according to such an embodiment, further, the same number of communication holes and leg portions may be formed at equal angular intervals in the circumferential direction with the corresponding communication holes and leg portions arranged in radial directions. When the plate spring receives an impact, a stress concentrates on narrow portions between adjacent communication holes. Thus, the durability of the plate spring can be further improved by forming the leg portions at positions far from such portions. In the electromagnetic pump according to such an embodiment, in addition, the suction check valve may be built in the support member; and the suction check valve and the discharge check valve may be coaxially disposed on an axis of reciprocal motion of the piston.

DESCRIPTION OF THE PREFERRED EMBODIMENTS

Now, a mode for carrying out the preferred embodiments will be described.

Figure 1:
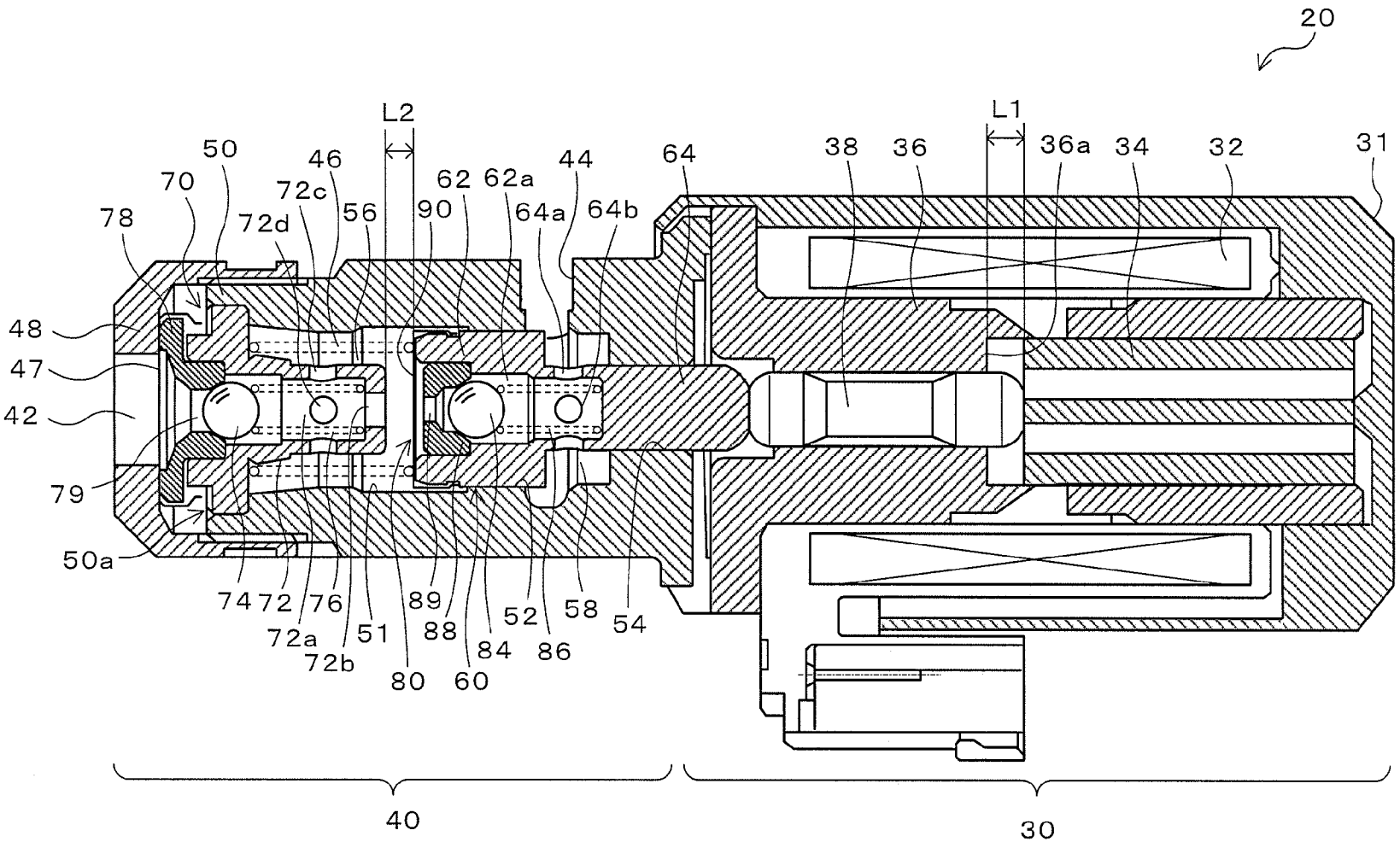
FIG. 1 is a diagram illustrating a schematic configuration of an electromagnetic pump 20 according to an embodiment.

FIG. 1 is a diagram illustrating a schematic configuration of an electromagnetic pump 20 according to an embodiment. The electromagnetic pump 20 according to the embodiment includes a solenoid portion 30 that generates an electromagnetic force, and a pump portion 40 actuated by the electromagnetic force of the solenoid portion 30. The electromagnetic pump 20 is configured as a pump that supplies a predetermined stand-by pressure to a friction engagement element for starting, among friction engagement elements provided in an automatic transmission, when an engine is stopped in an automobile on which the engine and the automatic transmission are mounted and which has an idling stop function for stopping the engine when an engine stopping condition such as a vehicle speed of less than a predetermined vehicle speed is met and for starting the engine which has been stopped when an engine starting condition is met, for example.

The solenoid portion 30 includes a solenoid case 31 that is a bottomed cylindrical member, an electromagnetic coil 32, a plunger 34 that serves as a movable element, and a core 36 that serves as a stationary element. The electromagnetic coil 32, the plunger 34, and the core 36 are disposed in the solenoid case 31. In the solenoid portion 30, a current is applied to the electromagnetic coil 32 to form a magnetic circuit in which magnetic flux circulates through the solenoid case 31, the plunger 34, and the core 36, and the plunger 34 is attracted to push out a shaft 38 provided in abutment with the distal end of the plunger 34. The core 36 is formed with a recessed portion 36*a* formed to have a diameter that is slightly larger than the diameter of the distal-end portion of the plunger 34 to receive the distal-end portion of the plunger 34 when the plunger 34 is attracted.

The pump portion 40 is configured as a piston pump that moves a piston 60 back and forth using the electromagnetic force from the solenoid portion 30 and the urging force of a coil spring 46 to pump working oil. The pump portion 40 includes: a cylinder 50 having a hollow cylindrical shape with its one end joined to the solenoid case 31 of the solenoid portion 30; the piston 60 slidably disposed inside the cylinder 50 with its base-end surface coaxially abutting against the distal end of the shaft 38 of the solenoid portion 30; the coil spring 46 that abuts against the distal-end surface of the piston 60 to urge the piston 60 in the direction opposite to the direction in which the electromagnetic force from the solenoid portion 30 is applied; a suction check valve 70 that supports the coil spring 46 from the side opposite to the distal-end surface of the piston 60, that permits working oil to flow in the direction of being suctioned into a pump chamber 56, and that prohibits working oil to flow in the opposite direction; a strainer 47 disposed at the suction port of the suction check valve 70 to trap foreign matter such as dust contained in suctioned working oil; a discharge check valve 80 that is built in the piston 60, that permits working oil to flow in the direction of being discharged from the pump chamber 56, and that prohibits working oil to flow in the opposite direction; and a cylinder cover 48 that covers the other end of the cylinder 50 with the piston 60, the discharge check valve 80, the coil spring 46, and the suction check valve 70 disposed inside the cylinder 50. In the pump portion 40, a suction port 42 is formed at the axial center of the cylinder cover 48, and a discharge port 44 is formed by cutting away a part of the side surface of the cylinder 50 in the circumferential direction.

The piston 60 is formed in a stepped shape with a piston main body 62 having a cylindrical shape, and a shaft portion 64 having a cylindrical shape with its end surface in abutment with the distal end of the shaft 38 of the solenoid portion 30 and being smaller in outside diameter than the piston main body 62. The piston 60 moves back and forth inside the cylinder 50 in conjunction with the shaft 38 of the solenoid portion 30. A bottomed hollow portion 62*a* having a cylindrical shape is formed at the axial center of the piston 60. The discharge check valve 80 is disposed in the hollow portion 62*a*. The hollow portion 62*a* extends from the distal-end portion of the piston 60 through the inside of the piston main body 62 to a middle of a space inside the shaft portion 64. The shaft portion 64 is formed with two through holes 64*a* and 64*b* that intersect each other at an angle of 90 degrees in the radial direction. The discharge port 44 is formed around the shaft portion 64. The hollow portion 62*a* communicates with the discharge port 44 via the two through holes 64*a* and 64*b*.

The suction check valve 70 includes a valve main body 72 fitted into the cylinder 50 and having a bottomed hollow portion 72*a* formed inside thereof and a center hole 72*b* formed at the axial center in the bottom of the hollow portion 72*a* to communicate between the hollow portion 72*a* and the pump chamber 56, a ball 74, a coil spring 76 that applies an urging force to the ball 74, and a plug 78 that serves as a seat portion for the ball 74 and that has a center hole 79 having an inside diameter that is smaller than the outside diameter of the ball 74. The suction check valve 70 is assembled by sequentially inserting the coil spring 76 and the ball 74 into the hollow portion 72*a* of the valve main body 72, and thereafter press-fitting the plug 78 into the hollow portion 72*a*.

Figure 2:
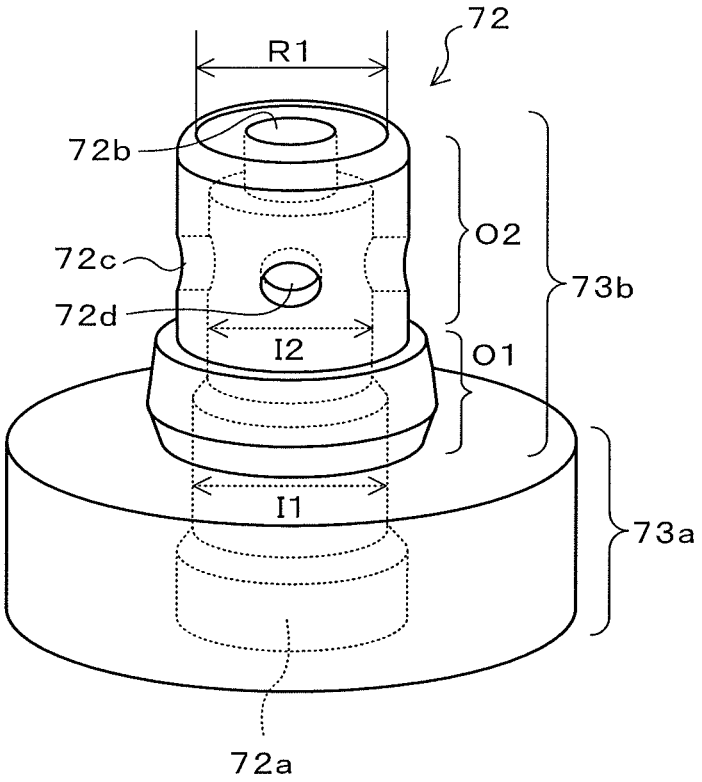
FIG. 2 is an appearance perspective view illustrating the appearance of a valve main body 72.

FIG. 2 is an appearance perspective view illustrating the appearance of the valve main body 72. As illustrated in the drawing, the valve main body 72 is formed in a stepped shape with a seat portion 73*a* having a cylindrical shape, and a projecting portion 73*b* having a generally cylindrical shape that projects from a seat surface of the seat portion 73*a*. The seat portion 73*a* supports the coil spring 46 with an annular surface of a peripheral edge portion of the seat surface. The height of the seat surface of the seat portion 73*a* is adjusted so as to allow spring spacing to achieve a necessary urging force. The projecting portion 73*b* is formed to project into the pump chamber 56. The projecting height and the diameter of the projecting portion 73*b* are adjusted so that a necessary discharge pressure is achieved by a volume inside the pump chamber 56.

The projecting portion 73*b* is formed in a stepped shape having a first outside diameter portion O1 and a second outside diameter portion O2 that is smaller in diameter than the first outside diameter portion O1, which are arranged in this order from the seat portion 73*a* side. The first outside diameter portion O1 is formed to have an outside diameter that is slightly smaller than the inside diameter of the coil spring 46. When the coil spring 46 is fitted, the first outside diameter portion O1 fixes the coil spring 46 so that the coil spring 46 will not be displaced in the radial direction. The second outside diameter portion O2 is formed in a cylindrical shape with a generally uniform outside diameter with respect to the axial direction. The second outside diameter portion O2 is formed with two through holes 72*c* and 72*d* that intersect each other at an angle of 90 degrees in the radial direction. In addition, the outer peripheral edge portion of the distal end (projecting end) of the projecting portion 73 is rounded. The projecting direction of the projecting portion 73*b* corresponds to the valve axis direction, and the first outside diameter portion O1 and the second outside diameter portion O2 at the outer periphery constitute the side wall of the projecting portion 73*b*. In addition, the back side of the projecting end of the projecting portion 73*b* serves as the bottom of the hollow portion 72*a*.

The hollow portion 72*a* formed inside the valve main body 72 extends along the axial center from the back surface of the seat portion 73*a* to penetrate the inside of the seat portion 73*a*, and extends to the vicinity of the projecting end of the projecting portion 73*b* so as to communicate with the center hole 72*b* and the two through holes 72*c* and 72*d*. The hollow portion 72*a* has a first inside diameter portion I1 having an inside diameter that is smaller than the outside diameter of the ball 74 to enable the ball 74 to move in the axial direction, and a second inside diameter portion I2 that is smaller in inside diameter than the first inside diameter portion I1 to house the coil spring 76. In the first inside diameter portion I1, the gap between the inner wall surface and the ball 74 serves as an oil passage for working oil. In the second inside diameter portion I2, the gap between the inner wall surface and the outer peripheral side of the coil spring 76, the gap between the coils of the coil spring 76, and the space on the inner peripheral side of the coil spring 76 serve as an oil passage for working oil.

The suction check valve 70 opens with the coil spring 76 compressed and the ball 74 moved away from the center hole 79 of the plug 78 when the pressure difference (P1−P2) between the input-side pressure P1 and the output-side pressure P2 is equal to or more than a predetermined pressure to overcome the urging force of the coil spring 76. The suction check valve 70 closes with the coil spring 76 expanded and the ball 74 pressed against the center hole 79 of the plug 78 to block the center hole 79 when the pressure difference (P1−P2) discussed above is less than the predetermined pressure.

The discharge check valve 80 includes a ball 84, a coil spring 86 that applies an urging force to the ball 84, and a plug 88 formed as an annular member with a center hole 89 having an inside diameter that is smaller than the outside diameter of the ball 84. The discharge check valve 80 is assembled by sequentially inserting the coil spring 86 and the ball 84 into the hollow portion 62*a* of the piston 60, and thereafter press-fitting the plug 88 into the hollow portion 62*a*. In the discharge check valve 80, the gap between the inner wall surface of the hollow portion 62*a* of the piston 62 and the outer peripheral side of the ball 84 and the coil spring 86 serves as an oil passage for working oil.

The discharge check valve 80 opens with the coil spring 86 compressed and the ball 84 moved away from the center hole 89 of the plug 88 when the pressure difference (P2–P3) between the input-side pressure (pressure on the output side of the suction check valve 70) P2 and the output-side pressure P3 is equal to or more than a predetermined pressure to overcome the urging force of the coil spring 86. The discharge check valve 80 closes with the coil spring 86 expanded and the ball 84 pressed against the center hole 89 of the plug 88 to block the center hole 89 when the pressure difference (P2–P3) discussed above is less than the predetermined pressure.

Figure 3:
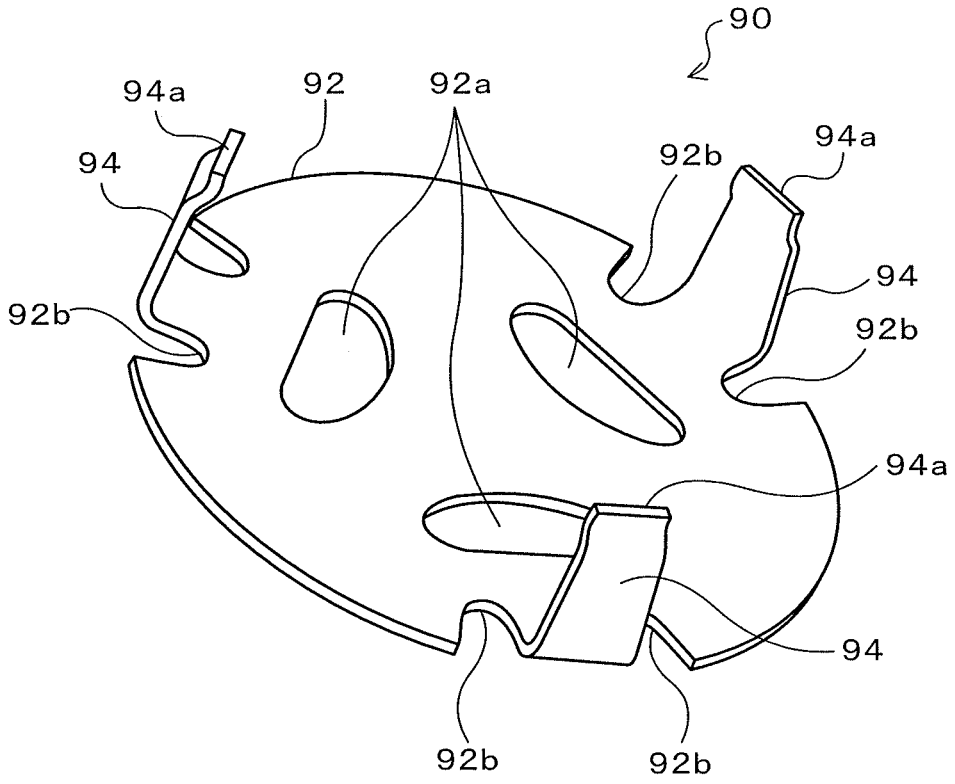
FIG. 3 is an appearance perspective view illustrating the appearance of a plate spring 90.
Figure 4:
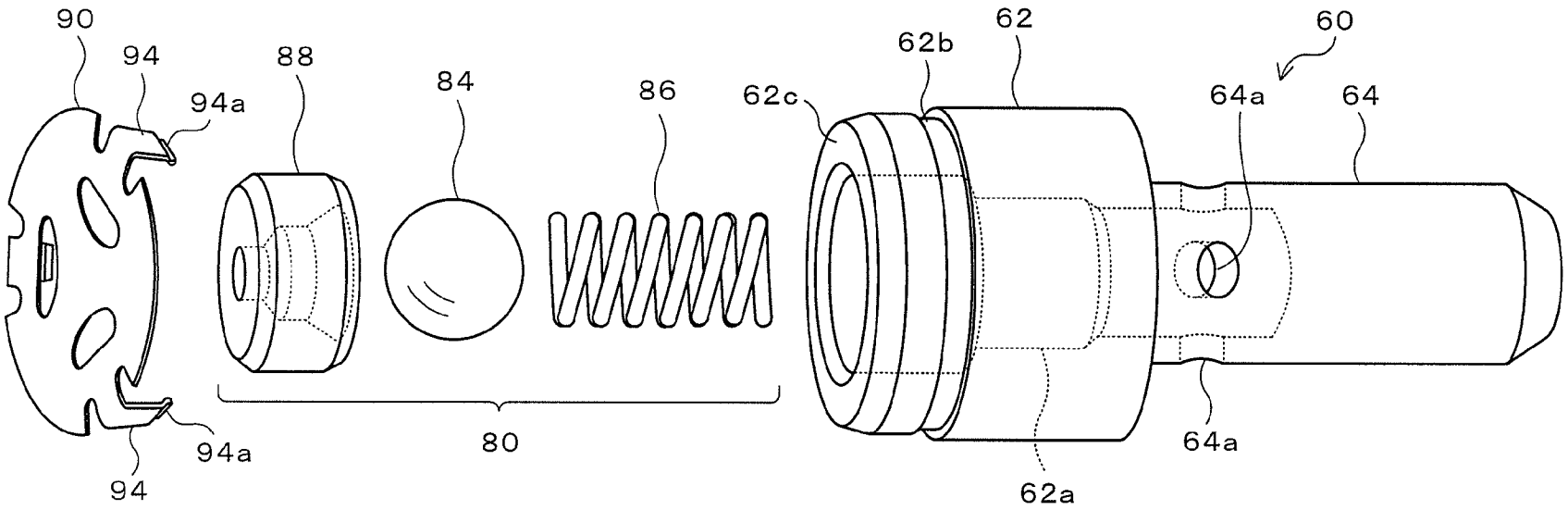
FIG. 4 illustrates how a discharge check valve 80 and the plate spring 90 are assembled to a piston 60.

In the electromagnetic pump 20 according to the embodiment, a plate spring 90 is attached so as to cover an opening of the hollow portion 62*a* of the piston 60. FIG. 3 is an appearance perspective view illustrating the appearance of the plate spring 90. FIG. 4 illustrates how the discharge check valve 80 and the plate spring 90 are assembled to the piston 60. The plate spring 90 is formed from magnetic metal such as iron. As illustrated in FIG. 3, the plate spring 90 includes a disc portion 92 in a disc shape formed with three communication holes 92*a* along the circumferential direction, and three leg portions 94 that extend in the orthogonal direction from the outer peripheral edge of the disc portion 92. The plate spring 90 is formed by shaping the outer shape by punching a flat plate member, and thereafter bending the three leg portions 94 in the orthogonal direction. In the embodiment, cut-away grooves 92*b* are formed on both sides of the root of the three leg portions 94 so that flatness in the vicinity of the outer peripheral edge of the disc portion 92 will not be impaired when the leg portions 94 are bent.

The three communication holes 92*a* are formed in a generally elliptic shape with the long sides extending in the circumferential direction and with the short sides extending in the radial direction. In the embodiment, the communication holes 92*a* are formed such that the radius of curvature on the radially outer side of the disc portion 92 is larger (more linear) than the radius of curvature on the radially inner side thereof. Hooks 94*a* that are bent inward are formed at the distal-end portions of the three leg portions 94 in order to mount the plate spring 90 to the piston main body 62. The communication holes 92*a* and the leg portions 94 are disposed at equal angular intervals (intervals of 120 degrees) so as to be arranged in radial directions. That is, the leg portions 94 are disposed at positions far from narrow portions between adjacent communication holes 92*a*. In the plate spring 90 according to the embodiment, when the disc portion 92 receives an impact, a stress tends to concentrate on the narrow portions between adjacent communication holes 92*a*. Therefore, the durability is secured by placing the leg portions 94 with relatively small strength away from the narrow portions.

As illustrated in FIG. 4, the discharge check valve 80 and the plate spring 90 are assembled to the piston 60 by sequentially inserting the coil spring 86 and the ball 84 into the hollow portion 62*a* of the piston main body 62, press-fitting the plug 88, thereafter mounting the plate spring 90 to the distal-end portion of the piston main body 62 to engage the hooks 94*a* of the leg portions 94 in a groove 62*b* formed in the outer peripheral portion of the piston main body 62, and riveting the outer peripheral portion of the piston main body 62. In the embodiment, the discharge check valve 80 and the plate spring 90 are assembled to the piston 60 in advance in this way to form a sub-assembly, and then the sub-assembly is disposed inside the cylinder 50.

Figure 5:
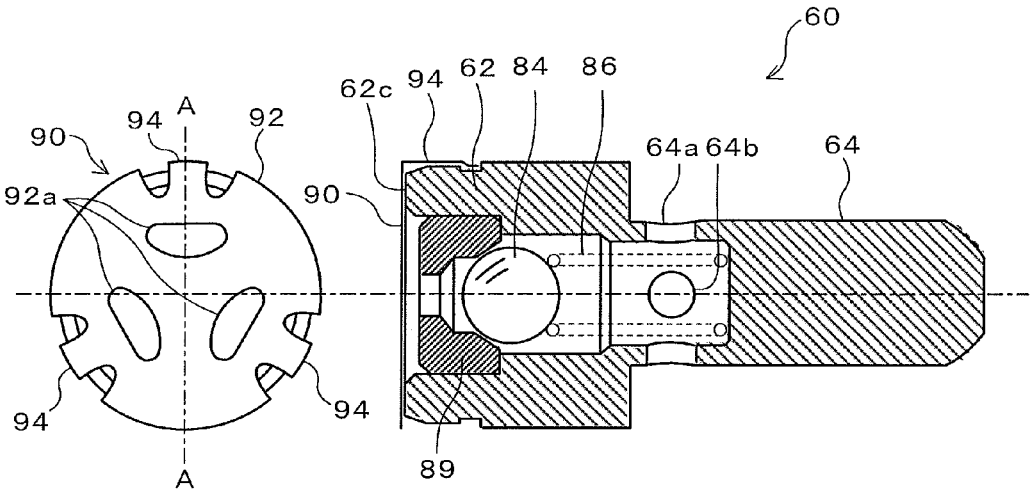
FIG. 5 includes a front view of the discharge check valve 80 and the plate spring 90 assembled to the piston 60 as seen from the plate spring 90 side, and a sectional view of the assembly taken along the line A-A.
Figure 6:
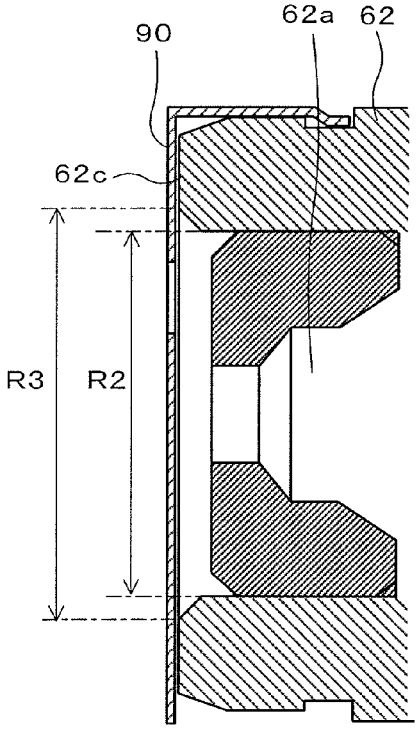
FIG. 6 is an enlarged partial view illustrating a part of the sectional view of FIG. 5 as enlarged.

FIG. 5 includes a front view of the discharge check valve 80 and the plate spring 90 assembled to the piston 60 as seen from the plate spring 90 side, and a sectional view of the assembly taken along the line A-A. FIG. 6 is an enlarged partial view illustrating a part of the sectional view of FIG. 5 as enlarged. When the plate spring 90 is assembled to the piston 60 together with the discharge check valve 80, as illustrated in FIG. 5, the outer peripheral portion of the disc portion 92, which does not include the three communication holes 92*a*, abuts against a cylindrical end surface 62*c* of the piston main body 62, and a clearance is secured between the inner peripheral portion of the disc portion 92, which includes the three communication holes 92*a*, and an end surface of the plug 88. That is, the inner peripheral portion of the disc portion 92 forms an elastically deformable region, and thus functions as a shock absorbing member that absorbs a shock applied to the region. In the embodiment, the inner peripheral edge of the cylindrical end surface 62*c* is chamfered, and the elastically deformable region (diameter) of the plate spring 90 is R3, which is larger than the inside diameter R2 of the hollow portion 62*a*. The outside diameter R1 (see FIG. 2) of the projecting end of the projecting portion 73*b* discussed earlier is smaller than the inside diameter R2. In the embodiment, the outer peripheral edge of the cylindrical end surface 62*c* of the piston main body 62 is also chamfered in order to facilitate mounting of the plate spring 90 to the piston main body 62.

In the cylinder 50, the pump chamber 56 is formed as a space surrounded by an inner wall 51, the distal-end surface (plate spring 90) of the piston 60, and a surface of the suction check valve 70 on the coil spring 46 side. When the piston 60 is moved (in reverse) by the urging force of the coil spring 46, the volume inside the pump chamber 56 is increased to open the suction check valve 70 and close the discharge check valve 80 so that the pump chamber 56 suctions working oil via the suction port 42. When the piston 60 is moved (forward) by the electromagnetic force of the solenoid portion 30, the volume inside the pump chamber 56 is reduced to close the suction check valve 70 and open the discharge check valve 80 so that the pump chamber 56 discharges the suctioned working oil via the discharge port 44.

The cylinder 50 is formed with a step between an inner wall 52, along which the piston main body 62 slides, and an inner wall 54, along which the shaft portion 64 slides. The discharge port 44 is formed at the stepped portion. The stepped portion forms a space surrounded by an annular surface of the stepped portion between the piston main body 62 and the shaft portion 64, and the outer peripheral surface of the shaft portion 64. The space is formed on the opposite side of the pump chamber 56 across the piston main body 62. Thus, the volume of the space is reduced when the volume of the pump chamber 56 is increased, and increased when the volume of the pump chamber 56 is reduced. In this event, variations in volume of the space are smaller than variations in volume of the pump chamber 56 because the area (pressure receiving area) over which the piston 60 receives a pressure from the pump chamber 56 side is larger than the area (pressure receiving area) over which the piston 60 receives a pressure from the discharge port 44 side. Therefore, the space serves as a second pump chamber 58. That is, when the piston 60 is moved (in reverse) by the urging force of the coil spring 46, an amount of working oil corresponding to the amount of increase in volume of the pump chamber 56 is suctioned from the suction port 42 into the pump chamber 56 via the suction check valve 70, and an amount of working oil corresponding to the amount of reduction in volume of the second pump chamber 58 is discharged from the second pump chamber 58 via the discharge port 44. When the piston 60 is moved (forward) by the electromagnetic force of the solenoid portion 30, an amount of working oil corresponding to the amount of reduction in volume of the pump chamber 56 is fed from the pump chamber 56 into the second pump chamber 58 via the discharge check valve 80, and an amount of working oil corresponding to the difference between the amount of reduction in volume of the pump chamber 56 and the amount of increase in volume of the second pump chamber 58 is discharged via the discharge port 44. Thus, working oil is discharged from the discharge port 44 twice while the piston 60 moves back and forth once, which makes it possible to reduce discharge non-uniformities and improve the discharge performance.

Here, in the electromagnetic pump 20 according to the embodiment, if the distance between the distal-end portion of the plunger 34 and the recessed portion 36*a* of the core 36 facing the distal-end portion of the plunger 34 is defined as L1 and the distance between the distal-end portion (plate spring 90) of the piston 60 and the projecting end surface of the valve main body 72 facing the distal-end portion of the piston 60 is defined as L2 with drive of the solenoid portion 30 stopped as illustrated in FIG. 1, L1 is designed to be larger than L2. Thus, when the piston 60 is moved forward along with drive of the solenoid portion 30, the plate spring 90 collides against the projecting end surface of the valve main body 72, and the plunger 34 does not collide against the core 36. The diameter of the elastically deformable region of the plate spring 90 is R3, which is larger than the outside diameter R1 of the projecting end surface of the valve main body 72. Thus, the plate spring 90 can absorb a shock applied to the piston 60 using an elastic force to suppress generation of a sound of collision. The electromagnetic pump 20 according to the embodiment is mounted on a vehicle, and driven when the vehicle is stationary with an engine stopped. Therefore, a generated abnormal sound may be easily heard by a passenger. Consequently, it is possible to further improve the comfort of the passenger by suppressing generation of a sound of collision accompanied by drive of the electromagnetic pump 20.

In the electromagnetic pump 20 according to the embodiment described above, the plate spring 90 is attached to the distal-end portion of the piston 60, and the distance L1 between the distal-end portion of the plunger 34 and the core 36 (recessed portion 36*a*) facing the distal-end portion of the plunger 34 is set to be shorter than the distance L2 between the distal-end portion (plate spring 90) of the piston 60 and the projecting end surface of the valve main body 72 facing the distal-end portion of the piston 60 with drive of the solenoid portion 30 stopped. Thus, the plate spring 90 is caused to collide against the projecting end surface of the valve main body 72 so that the plunger 34 does not collide against the core 36 when the solenoid portion 30 is driven. As a result, a shock applied to the piston 60 can be absorbed by the elastic force of the plate spring 90, which effectively suppresses generation of a sound of collision. Moreover, the inner peripheral edge of the cylindrical end surface 62*c* of the piston main body 62 is chamfered. Thus, the elastically deformable region of the plate spring 90 (disc portion 92) can be expanded, which further improves the shock absorbing performance. Further, the plate spring 90 which serves as an elastic member is disposed on the pump portion 40 side. Thus, magnetic metal such as iron, which cannot be used in the case where the elastic member is disposed in the solenoid portion 30, can be used as the material of the plate spring 90, which secures sufficient durability.

In the electromagnetic pump 20 according to the embodiment, in addition, the cut-away grooves 92*b* are formed on both sides of the root of the three leg portions 94. Thus, flatness in the vicinity of the outer peripheral edge of the disc portion 92 are not impaired when the plate spring 90 is formed by integrally forming the disc portion 92 and the leg portions 94 and thereafter bending the leg portions 94. As a result, the ease of assembly of the plate spring 90 can be further improved. In addition, the communication holes 92*a* and the leg portions 94 of the plate spring 90 are disposed at equal angular intervals so as to be arranged in radial directions. Thus, the leg portions 94 can be disposed at positions far from narrow portions between adjacent communication holes 92*a*. That is, when the disc portion 92 receives an impact, a stress tends to concentrate on the narrow portions between adjacent communication holes 92*a*. Therefore, the durability of the plate spring 90 can be further improved by placing the leg portions 94 with relatively small strength away from the narrow portions.

In the electromagnetic pump 20 according to the embodiment, in addition, the discharge check valve 80 and the plate spring 90 are assembled to the piston 60 in advance to form a sub-assembly, and then the sub-assembly is disposed inside the cylinder 50. Thus, the ease of assembly of the electromagnetic pump 20 can be further improved.

In the electromagnetic pump 20 according to the embodiment, the elastic member (plate spring 90) is provided on the piston 60 side. However, the present embodiment is not limited thereto, and the elastic member may be provided on the side of the valve main body 72 which supports the coil spring 46, and may be provided on both the piston 60 side and the valve main body 72 side depending on the configuration of the elastic member.

In the electromagnetic pump 20 according to the embodiment, the plate spring 90 is provided with three leg portions 94 formed at the outer peripheral edge of the disc portion 92. However, the present embodiment is not limited thereto, and the plate spring 90 may be provided with any plural number of leg portions such as four or six leg portions. It should be noted, however, that if the plate spring 90 is provided with three leg portions 94, the stability of fixation of the plate spring 90 to the piston 60 can be secured while reducing the number of the leg portions 94.

In the electromagnetic pump 20 according to the embodiment, the plate spring 90 is provided with the cut-away portions 92*b* formed on both sides of the root of the leg portions 94. However, the present embodiment is not limited thereto, and the plate spring 90 may not be provided with the cut-away portions 92*b*.

In the electromagnetic pump 20 according to the embodiment, the plate spring 90 is provided with three communication holes 92*a* formed in the disc portion 92. However, the present embodiment is not limited thereto, and the plate spring 90 may be provided with any number of communication holes. For example, the plate spring 90 may be provided with one communication hole, or a plurality of communication holes such as two or four communication holes. Alternatively, the plate spring 90 may be provided with a multiplicity of pores formed in the disc portion 92.

In the electromagnetic pump 20 according to the embodiment, the communication holes 92*a* formed in the disc portion 92 of the plate spring 90 have a generally elliptic shape. However, the present embodiment is not limited thereto, and the communication holes 92*a* may have any shape such as a circular shape, for example.

In the electromagnetic pump 20 according to the embodiment, an impact due to a collision between the valve main body 72 and the piston 60 is absorbed by the plate spring 90. However, the present embodiment is not limited thereto, and such an impact may be absorbed using other elastic members such as rubber, for example. It should be noted, however, that use of magnetic metal such as iron is desirable in order to secure the durability of the member.

In the electromagnetic pump 20 according to the embodiment, the suction check valve 70 and the plate spring 90 are attached to the piston 60 in advance to form a sub-assembly, which is then assembled into the cylinder 50. However, such components may be separately assembled into the cylinder 50.

In the electromagnetic pump 20 according to the embodiment, the discharge check valve 70 is built in the piston 60. However, the discharge check valve 80 may not be built in the piston 60, and may be incorporated in a valve body outside the cylinder 50, for example.

The electromagnetic pump 20 according to the embodiment is configured such that working oil is discharged from the discharge port 44 twice while the piston 60 moves back and forth once. However, the present embodiment is not limited thereto, and the electromagnetic pump 20 according to the embodiment may be any type of electromagnetic pump that can discharge a working fluid as the piston moves back and forth, such as a type in which working oil is suctioned from the suction port into the pump chamber when the piston is moved forward by the electromagnetic force from the solenoid portion and the working oil in the pump chamber is discharged from the discharge port when the piston is moved in reverse by the urging force of the coil spring, and a type in which working oil is suctioned from the suction port into the pump chamber when the piston is moved in reverse by the urging force of the coil spring and the working oil in the pump chamber is discharged from the discharge port when the piston is moved forward by the electromagnetic force from the solenoid portion.

The electromagnetic pump 20 according to the embodiment is used for a hydraulic control device that hydraulically drives clutches and brakes of an automatic transmission mounted on an automobile. However, the present embodiment is not limited thereto, and the electromagnetic pump 20 according to the embodiment may be applied to any system that transports fuel, transports a liquid for lubrication, or the like.

While a mode for has been described above by way of preferred embodiments, it is a matter of course that the embodiments are not limited in any way, and may be implemented in various forms.

INDUSTRIAL APPLICABILITY

The present embodiments described herein are applicable, for example, to the electromagnetic pump manufacturing industry and so forth.

The invention claimed is:

1. An electromagnetic pump in which a piston is moved back and forth to suction and discharge a working fluid, comprising:

an electromagnetic portion that attracts a plunger to a core using an electromagnetic force to apply thrust to a base-end portion of the piston to move the piston forward;

a spring that applies an urging force to a distal-end portion of the piston to move the piston in reverse;

a support member that supports the spring and that has a specific portion that faces the distal-end portion of the piston; and an elastic member provided to at least one of the distal-end portion of the piston and the specific portion of the support member, wherein a distance between the specific portion of the support member and the distal-end portion of the piston is shorter than a distance between the plunger and the core when the electromagnetic portion is stationary so that the distal-end portion of the piston collides against the specific portion of the support member via the elastic member when the electromagnetic portion is driven to move the piston forward.

2. The electromagnetic pump according to claim 1, wherein:

the support member is formed with a support portion that supports the spring, and a projecting portion that projects toward the distal-end portion of the piston with respect to the support portion; and the specific portion is a projecting end surface of the projecting portion.

3. The electromagnetic pump according to claim 1, wherein:

the spring is a coil spring;

the distal-end portion of the piston is formed as a cylindrical portion with an annular cylindrical end surface configured to receive an urging force of the coil spring;

the elastic member is a plate spring attached so as to cover an opening of the cylindrical portion; and the specific portion of the support member is formed such that an outside diameter of the specific portion is smaller than an inside diameter of the cylindrical portion.

4. The electromagnetic pump according to claim 3, wherein an inner peripheral edge of the cylindrical end surface of the cylindrical portion of the piston is chamfered.

5. The electromagnetic pump according to claim 3, wherein the plate spring includes a disc portion that covers the opening of the cylindrical portion, and a plurality of leg portions that extend along an axial direction of the cylindrical portion from an outer peripheral edge of the disc portion.

6. The electromagnetic pump according to claim 5, wherein the disc portion and the leg portions of the plate spring are formed integrally, and the plate spring is provided with cut-away portions formed on both sides of a root of the leg portions.

7. The electromagnetic pump according to claim 5 in which the piston is moved back and forth to suction the working fluid via a suction check valve and discharge the suctioned working fluid via a discharge check valve, wherein:

the discharge check valve is built in the cylindrical portion of the piston; and the plate spring is provided with a plurality of communication holes formed in a surface of collision that collides against the specific portion of the support member, the plurality of communication holes allowing the working fluid to flow into the discharge check valve.

8. The electromagnetic pump according to claim 7, wherein the communication holes are formed in the disc portion in a generally elliptic shape with long sides extending in a circumferential direction and with short sides extending in a radial direction.

9. The electromagnetic pump according to claim 7, wherein three communication holes are formed at equal angular intervals in the circumferential direction.

10. The electromagnetic pump according to claim 7, wherein the same number of communication holes and leg portions are formed at equal angular intervals in the circumferential direction with the corresponding communication holes and leg portions arranged in radial directions.

11. The electromagnetic pump according to claim 7, wherein:

the suction check valve is built in the support member; and the suction check valve and the discharge check valve are coaxially disposed on an axis of reciprocal motion of the piston.

* * * * *